United States Patent [19]

Machacek

[11] 4,096,003

[45] Jun. 20, 1978

[54] ALUMINUM, AMINE NITRATE SENSITIZED GEL EXPLOSIVE COMPOSITIONS

[75] Inventor: Oldrich Machacek, Allentown, Pa.

[73] Assignee: Atlas Powder Company, Tamaqua, Pa.

[21] Appl. No.: 805,422

[22] Filed: Jun. 10, 1977

[51] Int. Cl.[2] ..... C06B 45/00

[52] U.S. Cl. ..... 149/2; 149/38; 149/41; 149/42; 149/43; 149/92

[58] Field of Search ..... 149/2, 92, 41, 38, 42, 149/43, 114

[56] References Cited

U.S. PATENT DOCUMENTS 3,367,805 2/1968 Clay et al. ..... 149/114 X 3,409,484 11/1968 Minnick ..... 149/21

*Primary Examiner*—Stephen J. Lechert, Jr.

*Attorney, Agent, or Firm*—Richards, Harris & Medlock

[57] ABSTRACT

A water gel explosive composition and process for preparing the same is provided which comprises an oxidizer, water, a gelling agent, and a crosslinker, and wherein the improvement comprises including therein from about 1 to about 10 weight percent of at least one amine nitrate sensitizer selected from the group comprising lower alkyl and alkanol amine nitrates and from about 1 to about 10 weight percent of an aluminum sensitizer having a surface area per unit weight of from about 3 to about 9 square meters per gram, said weight percentages based upon the total weight of the explosive composition.

28 Claims, No Drawings

ALUMINUM, AMINE NITRATE SENSITIZED GEL EXPLOSIVE COMPOSITIONS

BACKGROUND OF THE INVENTION

This invention relates to water gel explosive compositions and particularly to incorporating therewith sensitizing amounts of certain amine nitrate sensitizers and an aluminum sensitizer having from about 3 to about 9 square meters of surface area per gram. In another aspect, this invention relates to an improved water gel explosive composition wherein the sensitizing effects of paint grade aluminum are significantly enhanced by employing relatively small amounts of certain amine nitrate sensitizers. In a further aspect this invention relates to a process for producing water gel explosive compositions sensitized with a combination of paint grade aluminum and certain amine nitrate sensitizing agents.

Modern water gel cap sensitive explosive compositions are, in some cases, sensitized by addition of some type of an alkyl or alkanol amine nitrate. Exemplary of an alkyl amine nitrate component is methylamine nitrate, which has, heretofore, been incorporated in relatively large weight percentage amounts in the water gel explosive composition in order to achieve sufficient sensitivity. Typically, at least between about 30 to about 40 weight percent of methylamine nitrate or similar amine nitrates has been required in order to produce a cap sensitive water gel explosive. Entrained air bubbles or microballoons must also be added to achieve the desired sensitivity. However, even with the use of such large quantities of methylamine nitrate, it has been found difficult to obtain low temperature detonatability below about 40° to about 50° F. Explosives having low temperature detonation characteristics are required for use in numerous applications, such as underground mines, and above ground applications, such as ditching operations in colder climates. Further, it is difficult to obtain water gel explosives which meet the air gap test standards (as further defined hereinafter) so as to be suitable for use as "permissibles" in mining operations even if relatively large amounts of amine nitrate sensitizers are employed.

In order to provide a suitable amine nitrate component content in the explosive composition, highly concentrated water solutions of the amine nitrate component are required. Recent studies have shown that concentrated water solutions having greater than approximately 65 weight percent or more of the amine nitrate component are very sensitive to mechanical handling and are easily detonated by relatively low mechanical impulses. Thus, preparation of water gel cap sensitive explosive compositions, sensitized solely by large amounts of an amine nitrate component, can be extremely dangerous unless performed with care. An example of water gel explosives containing relatively large quantities of amine nitrates are the explosives described in U.S. Pat. No. 3,431,155, issued Mar. 4, 1969.

Water gel cap sensitive explosive compositions have also been sensitized by other materials such as paint grade aluminum. These gels often contain from about 3 to about 6 weight percent paint grade aluminum. This sensitizer can be a very effective sensitizer, but it is difficult to handle because of severe dusting problems. Recently nondusting types of paint grade aluminum have been developed which partially alleviate these handling problems. However, there are limits on the maximum achievable sensitivity, and explosive compositions containing paint grade aluminum are not sufficiently sensitive for certain important applications. In this regard, it is difficult to achieve adequate cap sensitivity at temperatures at or below 40° or 50° F even when up to about 7.5 percent paint grade aluminum is employed. Finally, paint grade aluminum sensitized water gel explosive compositions often have difficulty in detonating across a three inch air gap in the standard half cartridge test. This test is required by the Bureau of Mines for explosives which are to be employed in underground coal mining applications. Basically, the test requires that one half of a cartridge of explosive be able to detonate a second half across an air gap of at least 3 inches. Explosive compositions passing this test, and the other requirements of the Bureau of Mines, are referred to as "permissibles" in that use of the explosives is approved and permitted in underground coal mining procedures. The term "permissible explosives" as used herein is defined to mean explosive compositions which meet the standards set forth by the Bureau of Mines in 30 C.F.R. 15, et seq. These standards include the above described air gap test as well as other requirements including, composition tolerances, propagation characteristics, gallery test requirements, poisonous gas production limits, and friction tolerances. Interestingly, the air gap sensitivity characteristics necessary to pass "permissible" standards and low temperature detonatability cannot be significantly improved by increasing the amount of paint grade aluminum in the water gel explosive compositions.

In summary, although amine nitrate components as well as paint grade aluminum have been incorporated into water gel explosive compositions, these compositions have proved inadequate or marginal for certain, important field applications. Thus, U.S. Pat. No. 3,962,001 discloses explosive compositions having improved low temperature detonation characteristics which comprise hexamethylenetetramine and paint grade aluminum as well as nitric acid. However, such compositions must be prepared following critical process conditions which limit their commercial desirability. The present invention has been provided to remedy these deficiencies as the explosive compositions disclosed herein exhibit excellent low temperature detonability, and air gap sensitivity.

SUMMARY OF THE INVENTION

According to the present invention, a water gel explosive composition is provided which comprises an oxidizer, water, a gelling agent, and a crosslinker, and wherein the improvement comprises including from about 1 to about 10 weight percent of at least one amine nitrate sensitizer selected from the group comprising lower alkyl and alkanol amine nitrates, and from about 1 to about 10 weight percent of an aluminum sensitizer, having a surface area per unit weight of from about 3 to about 9 square meters per gram, said weight percentages based upon the total weight of the explosive composition. It has been discovered that by employing relatively minor amounts of amine nitrate sensitizers in combination with such aluminum sensitizers a synergistic increase in low temperature detonability characteristics and in the sensitizing characteristics necessary to achieve the air gap detonation qualities required by the Bureau of Mines for "permissible" explosives, is achieved.

DETAILED DESCRIPTION OF THE INVENTION

According to the present invention, small sensitizing amounts of certain amine nitrates along with aluminum particles having relatively high surface area per unit weight interact as a dual sensitizer component which is incorporated in a water gel explosive composition to achieve low temperature detonation and sensitizing characteristics which were previously difficult to obtain in water gel explosive compositions. Water gel explosive compositions normally comprise at least an oxidizer, water, a gelling agent, and a cross-linking agent. The improvement disclosed herein comprises including in such a water gel explosive composition, from about 1 to about 10 weight percent of at least one amine nitrate sensitizer selected from the group comprising lower alkyl and alkanol amine nitrates and from about 1 to about 10 weight percent of an aluminum sensitizer having an average surface area of between about 3 to about 9 sq. m/g, said weight percentages based upon the total weight of the explosive composition. The interaction of the two sensitizer components produces an explosive composition having detonation characteristics unexpectedly greater then when the aluminum or amine nitrates are used alone.

The disclosed explosive compositions exhibit low temperature sensitivity which enable the explosive compositions to be detonatable at temperatures as low as 0° F. An explosive composition having only paint grade aluminum as the sensitizer component and not incorporating any amine nitrates therein, is not cap sensitive below about 40°–50° F. Therefore, explosive compositions of the type disclosed herein, exhibiting low temperature detonatable characteristics, may be effectively used in numerous applications including use in underground mines where low temperatures are often encountered.

The explosive compositions disclosed herein, having small amounts of certain amine nitrates in combination with paint grade aluminum or other aluminum sensitizing agents having comparable surface area per unit weight, also exhibit improved air gap sensitivity. Explosive compositions incorporating only paint grade aluminum are generally not detonatable across an air gap of more than 3 inches (as required by the Bureau of Mines standard half cartridge test for permissible explosives). The present explosive compositions increase the air gap sensitivity to a point where detonation occurs even across a 7 inch air gap. Thus, improved air gap sensitivity is achievable when the explosive compositions are prepared according to the process disclosed herein.

Interestingly, the improved explosive compositions exhibit good low temperature detonability and air gap sensitivity characteristics even when sodium chloride is present. Sodium chloride is often incorporated in explosive compositions for the purpose of improving the incendivity characteristics of the explosive composition in natural gas-air and natural gas-air-coal dust mixtures. Thus, because of the extraordinary air gap sensitivity characteristics of the explosive compositions of the present invention (in some cases 7 inches or more) the addition of sodium chloride, while detrimental to air gap sensitivity does not reduce such sensitivity below the required 3 inch range.

As discussed hereinbefore, it has been found that by incorporating small sensitizing amounts of certain amine nitrates with paint grade aluminum, an improved explosive composition is produced having unexpected characteristics. The amine nitrate sensitizers suitable for inclusion in the improved explosive composition herein are lower alkyl and alkanol amine nitrates. More than one of these amine nitrates may be included in the explosive composition, but generally only one amine nitrate sensitizer is utilized. The preferred amine nitrate sensitizer for incorporation in the improved explosive compositions is methylamine nitrate. However, other exemplary lower alkyl and alkanol amine nitrate sensitizers include ethylamine nitrate, ethanolamine nitrate, propanolamine nitrate, ethylenediamine dinitrate, and similar amine nitrates having from about 1 to about 3 carbon atoms.

Previously known explosive compositions have incorporated therein large amounts of similar amine nitrates to produce a water gel explosive composition. It has been found that the mere incorporation of small amounts of amine nitrate sensitizers, without paint grade aluminum, will not produce explosive compositions exhibiting the above-identified desirable characteristics. Moreover, the incorporation in explosive compositions of small amounts of amine nitrate with finely divided aluminum also does not produce a satisfactory explosive. However, it has been found that incorporation of small sensitizing amounts of at least one amine nitrate sensitizer discussed above with an aluminum sensitizing agent having an average surface area of from about 3 to about 9 sq. m/g, such as paint grade aluminum, will result in an explosive composition having characteristics superior to those previously known in the art.

In this regard, the previous explosive compositions have incorporated usually from about 30 to about 40 weight percent of the amine nitrate sensitizer in the explosive composition. Applicant has found that the incorporation of only small sensitizing amounts of the amine nitrate, in combination with paint grade aluminum, produces an excellent explosive composition. Generally, the amine nitrate sensitizer should be included in amounts from about 1 to about 10 weight percentage, based upon the total weight of the explosive composition. In the preferred embodiment, the explosive composition should include from about 5 to about 10 weight percent of the amine nitrate sensitizer and most preferably about 8% thereof.

Regarding the paint grade aluminum sensitizer, this constituent is utilized in the present explosive composition as a main sensitizer. This should be contrasted from those previously known explosive compositions which incorporate aluminum as an auxiliary fuel. The aluminum incorporated as an auxiliary fuel is generally divided or atomized aluminum which does not have the large surface area per unit weight characteristics of paint grade types of aluminum. It has been determined that if paint grade aluminum, or aluminum having relatively large surface areas per unit weight, is utilized in combination with the amine nitrate sensitizer, a superior explosive composition results. Generally, the aluminum sensitizer component should have a surface area per unit weight of between about 3 to about 9 sq. m/g, and, for economical reasons, preferably from about 5 to about 6 sq. m/g. Paint grade aluminum of both the dusting and nondusting varieties can be employed to achieve the improved characteristics of the compositions of the subject invention. This is contrasted with finely divided aluminum which is generally incorporated as an auxiliary fuel, and has surface areas of less than 1 sq. m/g, usually in the range of from about 0.05 to about 0.2 sq. m/g. Procedures useful in determining the surface area per unit weight of aluminum particles are set forth in Alcoa Aluminum Co.'s publication entitled "Quality Control and Analytical Test Methods for Alcoa Aluminum Powders", July 1975.

In the preferred embodiment, a water gel explosive composition comprises from about 40 to about 80 weight percent oxidizer, from about 10 to about 20 weight percent water, from about 0.1 to about 3 weight percent gelling agent, from about 0.02 to 0.3 weight percent cross-linking agent, from about 5 to about 10 weight percent of at least one amine nitrate sensitizer, and from about 3 to about 5 weight percent paint grade type aluminum sensitizer. Explosive compositions within those weight percentages exhibit the unique and unexpected characteristics of low temperature detonability, and increased air gap sensitivity.

Fuels, such as particulate or finely divided aluminum, can be added to the composition for higher sensitivity or increased power output. Also, voids may be incorporated within the explosive composition mixture to increase the sensitivity thereof. For instance, air bubbles, hollow glass spheres, resin balloons, and perlite may be incorporated into the explosive composition. It is desired that the oxygen balance of the explosive compositions be between about −10 to about +10. To adjust the oxygen balance, liquid or solid fuels commonly used in the explosives art may be added to the present improved explosive composition. Examples include ethylene glycol, particulate aluminum and urea.

Inorganic oxidizing agents which can be used to formulate explosive compositions of the subject invention include the nitrate and perchlorate salts of ammonium, alkali, or alkaline earth or Group III elements such as ammonium nitrate, sodium nitrate and sodium perchlorate, for example. Preferably, ammonium nitrate is employed as the main oxidizing agent in combination with one or more other suitable oxidizing agents, the ammonium nitrate comprising at least about 30% of the total explosive composition.

For gelling the aqueous solution, the more conventional water soluble gums and gel modifiers, such as guar gum and chemically modified guars, can be used satisfactorily. Other examples of gelling agents and gel modifiers for the aqueous solution are carboxymethyl cellulose, methyl cellulose, synthetic polymers, polyacrylamides and polyvinyl alcohols.

Suitable crosslinking agents for the gelling agents include polyvalent metal salts, borates, chromates, dichromates, antimonates, oxalates, and tartrates. Potassium pyroantimonate is an excellent cross-linker.

When sodium chloride is employed to improve the incendivity properties of the composition, as much as 20% by weight of the composition can be used. However, large amounts of salt are detrimental to the detonation characteristics of the explosive composition and therefore sodium chloride is preferably employed in amounts range from about 3 to about 10% by weight of the composition.

EXAMPLES

The following examples are presented to exemplify and illustrate the present invention to those of ordinary skill in the art and are not intended to limit the subject invention in any manner.

EXAMPLE 1

Water gel explosive compositions were prepared according to the subject invention in the following manner. First, approximately one-half of the water employed is heated to about 120° F and all of the sodium nitrate, in prill form, and approximately one-half of the ammonium nitrate, in flake form, is dissolved therein. A water solution of the amine nitrate sensitizer is then admixed with the above solution, the amine nitrate having been dissolved in the remaining portion of the water which is to be added to the composition. Buffering agents such as ammonium phosphate are then added for pH adjustment. The remaining portion of ammonium nitrate, in prilled form, is then added to the aqueous solution. The aqueous gelling agent, premixed with a cross-linker therefor, is then added to the solution. High speed stirring or other means of agitation is then employed to incorporate air into the solution as it thickens. Finally, paint grade aluminum, mixed with ethylene glycol for ease in handling, is incorporated into the thickened solution.

The above procedure was employed to produce water gel explosives having the compositions and densities set forth in Table I.

TABLE I

| | 1 | 2 | 3 | 4 |
|---|---|---|---|---|
| Ammonium Nitrate | 43.3 | 55.6 | 63.7 | 43.2 |
| Sodium Nitrate | 13.2 | 10.0 | 7.2 | 13.2 |
| Water | 20.0 | 15.8 | 10.8 | 20.0 |
| Monomethylaminenitrate | 8.0 | 8.0 | 8.0 | — |
| Monoethanolaminenitrate | — | — | — | 8.0 |
| Sodium Chloride | 5.0 | — | — | 5.0 |
| Ammonium Phosphate | — | 0.15 | 0.1 | — |
| Guar Gum (and crosslinker) | 1.2 | 1.05 | 0.8 | 1.3 |
| Ethylene Glycol | 5.3 | 5.4 | 5.4 | 5.3 |
| Paint Grade Aluminum | 4.0 | 4.0 | 4.0 | 4.0 |
| Density g/cc | 1.16 | 1.15 | 1.17 | 1.15 |
| Low Temperature Detonability - #6 Cap | 10° F | 0° F | 10° F | 30° F |
| Half Cartridge Air Gap Test | 5" | 7" | 6" | 5" |

As can be seen from Table I these compositions exhibited excellent low temperature and gap detonation characteristics.

EXAMPLE 2

The following example is set forth to exemplify the synergistic effect on air gap sensitivity which has been discovered to be present when a combination of paint grade aluminum (or other particulate aluminum having relatively large surface areas per unit weight) is employed in combination with a relatively minor portion of an amine nitrate sensitizer. The compositions set forth below in Table II were prepared in substantially the same manner as was described in Example 1.

TABLE II

| | 1 | 2 | 3 |
|---|---|---|---|
| Ammonium Nitrate | 60.0 | 64.3 | 65.35 |
| Sodium Nitrate | 5.0 | 5.6 | 10.0 |
| Water | 16.0 | 20.0 | 18.0 |
| Monomethylaminenitrate | 8.0 | — | 8.0 |
| Ammonium Phosphate | 0.2 | 0.1 | 0.1 |
| Ethyleneglycol | — | 3.0 | 4.35 |
| Urea | 6.0 | — | — |
| Paint grade Aluminum | 4.0 | 6.0 | 3.25 |
| Guar Gum (and cross-linker) | 0.8 | 1.0 | 0.95 |
| Density, g/cc | 1.17 | 1.13 | 1.16 |
| Half Cartridge Air Gap Test Low Temperature | 7" | 2" | 7" |

TABLE II-continued

| | 1 | 2 | 3 |
|---|---|---|---|
| Dependability | <14° F | 40° F | ≦20° F |

As can be seen from Table II the sensitivity of the compositions of columns 1 and 3 to the half cartridge air gap test are greatly improved over the composition of column 2. Thus, the compositions of both columns 1 and 3 would meet the air gap standards of the Bureau of Mines for "permissibles" for use in underground mining operations. The composition of column 2, which does not employ an amine nitrate sensitizer, would fail to meet those standards because of the air gap sensitivity of less than 3".

While the invention has been described in relation to its preferred embodiments, it is to be understood that various modifications thereof will be apparent to those of ordinary skill in the art upon reading the specification, and it is intended to cover all such modifications which fall within the scope of the appended claims.

What is claimed is:

1. In a gel explosive composition comprising inorganic oxidizing agents, water, entrapped air and gelling agents, the improvement comprising including therein:

(a) from about 1 to about 10 weight percent of at least one amine nitrate sensitizer selected from the group comprising lower alkyl and alkanol amine nitrates; and (b) from about 1 to about 10 weight percent of an aluminum sensitizer having a surface area per unit weight of from about 3 to about 9 sq. m/g;

said weight percentages based upon the total weight of the gel explosive composition.

2. The explosive composition of claim 1 wherein the amine nitrate sensitizer is methylamine nitrate.

3. The explosive composition of claim 1 wherein the amine nitrate sensitizer comprises between about 5 to about 8 weight percent of the total explosive composition.

4. The explosive composition of claim 1 wherein the aluminum sensitizer is paint grade aluminum.

5. The explosive composition of claim 1 wherein the explosive composition also includes a fuel component.

6. The explosive composition of claim 5 wherein said fuel component is selected from the group consisting of ethylene glycol, particulate aluminum, urea and mixtures thereof.

7. The explosive composition of claim 1 wherein said entrapped air is supplied by incorporating into said composition a member selected from the group consisting of hollow glas spheres, resin balloons, perlite, and mixtures thereof.

8. The gel explosive composition of claim 1 wherein said inorganic oxidizing agents comprise ammonium nitrate and a member selected from the group consisting of nitrate and perchlorate salts of alkali, or alkaline earth or Group III elements, and mixtures thereof.

9. The gel explosive compositions of claim 1 wherein said inorganic oxidizing agenst comprise ammonium nitrate and a member selected from the group consisting of sodium nitrate, sodium perchlorate and mixtures thereof.

10. The explosive composition of claim 1 wherein said gelling agent is a member selected from the group consisting of guar gum, chemically modified guar gum, carboxymethyl cellulose, methyl cellulose, synthetic polymers, polyacrylamides and polyvinyl alcohols.

11. The explosive composition of claim 10 wherein the gelling agent is guar gum.

12. The explosive composition of claim 1 and further comprising a crosslinking agent selected from the group consisting of metal salts of borates, chromates, dichromates, antimonates, tartrates and oxalates.

13. The explosive composition of claim 12 wherein the cross-linking agent is potassium pyroantimonate.

14. The explosive composition of claim 1 and further comprising sodium chloride in an amount of from about 3 to about 10% by weight of said gel explosive composition.

15. A water gel explosive composition comprising:

(a) from about 40 to about 80 weight percent inorganic oxidizer;

(b) from about 10 to about 30 weight percent water;

(c) from about 0.1 to about 2.0 weight percent gelling agent;

(d) from about 0.02 to 0.3 weight percent cross-linking agent;

(e) from about 1 to about 10 weight percent of at least one amine nitrate sensitizer selected from the group comprising lower alkyl and alkanol amine nitrates; and (f) from about 1 to about 10 weight percent of an aluminum sensitizer having a surface area per unit weight of from about 3 to about 9 sq. m/g.

16. In a process for producing gel explosive compositions comprising inorganic oxidizing agents, water, and gelling agents, the improvement comprising:

admixing from about 1 to about 10% by weight of an aluminum sensitizing agent having a surface area per unit weight of from about 3 to about 9 sq. m/g with a thickened aqueous medium comprising inorganic oxidizing agents, water, gelling agents and from about 1 to about 10% by weight of an amine nitrate sensitizing agent selected from the group consisting of lower alkyl and alkanol amine nitrates at a mixing rate sufficient to entrap air within said thickened solution.

17. The process of claim 16 wherein the amine nitrate sensitizing agent is methylamine nitrate.

18. The process of claim 16 wherein the amine nitrate sensitizing agent comprises between about 5 to about 8 weight percent of the total weight of the explosive composition.

19. The process of claim 16 wherein the aluminum sensitizing agent is paint grade aluminum.

20. The process of claim 16 wherein the explosive composition also includes a fuel component.

21. The process of claim 20 wherein the fuel component is selected from a group consisting of ethylene glycol, particulate aluminum and urea.

22. The process of claim 16 wherein the inorganic oxidizing agent is selected from a group consisting of ammonium nitrate and a mixture of ammonium nitrate and sodium nitrate.

23. The process of claim 16 wherein the gelling agent is a member selected from the group consisting of guar gum, chemically modified guar gum, carboxymethyl cellulose, methyl cellulose, synthetic polymers, polyacrylamides and polyvinyl alcohols.

24. The process of claim 23 wherein the gelling agent is guar gum.

25. The process of claim 16 and further comprising admixing a cross-linking agent therewith wherein said cross-linking agent is selected from the group consisting of metal salts of borates, chromates, dichromates, antimonates, tartarates and oxalates.

26. The process of claim 25 wherein the cross-linking agent is potassium pyroantimonate.

27. A permissible explosive composition comprising from about 1 to about 10 weight percent of at least one amine nitrate sensitizer selected from the group consisting of lower alkyl and alkanol amine nitrates and from about 1 to about 10 weight percent of an aluminum sensitizer having a surface area per unit weight of from about 3 to about 9 sq. m/g.

28. The permissible explosive composition of claim 27 wherein said amine nitrate sensitizer is methylamine nitrate.

* * * * *